US009409659B2

(12) United States Patent
Carroll et al.

(10) Patent No.: US 9,409,659 B2
(45) Date of Patent: Aug. 9, 2016

(54) FLAVORED PACKAGING INSERT FOR SMOKELESS TOBACCO

(71) Applicant: Philip Morris USA Inc., Richmond, VA (US)

(72) Inventors: Andrew N. Carroll, Chesterfield, VA (US); Steven J. Hovjacky, Chesterfield, VA (US); Beverly C. Woodson, Ruther Glen, VA (US)

(73) Assignee: Philip Morris USA Inc., Richmond, VA (US)

( * ) Notice: Subject to any disclaimer, the term of this patent is extended or adjusted under 35 U.S.C. 154(b) by 358 days.

(21) Appl. No.: 13/860,933

(22) Filed: Apr. 11, 2013

(65) Prior Publication Data

US 2013/0219835 A1 Aug. 29, 2013

Related U.S. Application Data

(62) Division of application No. 12/576,998, filed on Oct. 9, 2009, now Pat. No. 8,440,023.

(51) Int. Cl.

| | |
|---|---|
| ***B65B 19/04*** | (2006.01) |
| ***B65B 1/04*** | (2006.01) |
| ***A24F 23/00*** | (2006.01) |
| ***B65D 81/00*** | (2006.01) |

(52) U.S. Cl.
CPC . *B65B 1/04* (2013.01); *A24F 23/00* (2013.01); *B65D 81/00* (2013.01)

(58) Field of Classification Search
None
See application file for complete search history.

(56) References Cited

U.S. PATENT DOCUMENTS

| | | | |
|---|---|---|---|
| 411,773 | A | 10/1889 | Atkinson |
| D26,315 | S | 11/1896 | Miller |
| D28,413 | S | 3/1898 | Taite |
| 663,415 | A | 12/1900 | Charles |
| 2,051,777 | A | 8/1936 | Purinton et al. |
| 2,157,255 | A | 5/1939 | Bumpass |
| D193,219 | S | 7/1962 | Burdick et al. |
| 3,206,016 | A | 9/1965 | Fowle et al. |
| 4,098,421 | A | 7/1978 | Foster |
| 4,190,170 | A | 2/1980 | Boyd |
| 4,646,933 | A | 3/1987 | Jurczenia et al. |

(Continued)

FOREIGN PATENT DOCUMENTS

| | | | |
|---|---|---|---|
| CH | 694145 | A5 | 8/2004 |
| EP | 0454003 | A1 | 10/1991 |

(Continued)

OTHER PUBLICATIONS

Partial International Search Report dated Oct. 13, 2008 for PCT/IB2008/001836.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A package of smokeless tobacco includes a flavor patch located in the package to provide flavor to smokeless tobacco. Also disclosed is a method of packaging smokeless tobacco by combining a package with a flavor patch disposed inside the package, the flavor patch comprising a flavor and an adsorbent, so that the flavor patch resides in an interior of the package; and adding smokeless tobacco to the package with the flavor patch.

14 Claims, 2 Drawing Sheets

(56) References Cited

U.S. PATENT DOCUMENTS

| | | | |
|---|---|---|---|
| 4,715,496 | A | 12/1987 | Hackmann |
| 4,717,017 | A | 1/1988 | Sprinkel, Jr. et al. |
| 4,848,929 | A | 7/1989 | Rawl |
| 4,850,504 | A | 7/1989 | Gindrod et al. |
| 5,249,676 | A | 10/1993 | Ashcraft et al. |
| 5,259,526 | A | 11/1993 | Stolzman |
| 5,460,287 | A | 10/1995 | Cargile et al. |
| 5,656,315 | A | 8/1997 | Tucker et al. |
| 5,676,272 | A | 10/1997 | Baerenwald |
| 5,724,997 | A | 3/1998 | Smith et al. |
| 5,791,473 | A | 8/1998 | Decker et al. |
| 5,794,814 | A | 8/1998 | Baerenwald |
| 5,816,264 | A | 10/1998 | Sebastiani |
| 5,938,018 | A | 8/1999 | Keaveney et al. |
| 6,045,833 | A | 4/2000 | Landau |
| 6,612,429 | B2 | 9/2003 | Dennen |
| 6,658,822 | B1 | 12/2003 | Dittrich |
| 6,692,835 | B1 | 2/2004 | Tomel, Jr. |
| 6,752,265 | B1 | 6/2004 | Draghetti et al. |
| D494,474 | S | 8/2004 | Houk et al. |
| D499,025 | S | 11/2004 | Houk et al. |
| D510,524 | S | 10/2005 | Houk et al. |
| D512,636 | S | 12/2005 | Pace |
| D513,386 | S | 1/2006 | Pace et al. |
| D514,936 | S | 2/2006 | Pace et al. |
| D515,426 | S | 2/2006 | Pace et al. |
| D515,429 | S | 2/2006 | Pace |
| D515,439 | S | 2/2006 | Pace |
| D515,928 | S | 2/2006 | Pace |
| 7,005,152 | B2 | 2/2006 | Landau |
| D518,728 | S | 4/2006 | Frantz |
| D523,752 | S | 6/2006 | Bried et al. |
| D531,036 | S | 10/2006 | Bried et al. |
| D541,176 | S | 4/2007 | Bried |
| 7,861,728 | B2 | 1/2011 | Holton, Jr. et al. |
| 8,393,465 | B2 | 3/2013 | Clark et al. |
| 8,440,023 | B2 | 5/2013 | Carroll et al. |
| 2005/0173272 | A1 | 8/2005 | Lemmons, IV |
| 2006/0051465 | A1 | 3/2006 | Kyle et al. |
| 2006/0060480 | A1 | 3/2006 | Budd |
| 2006/0101564 | A1 | 5/2006 | Powdermaker |
| 2006/0118589 | A1 | 6/2006 | Arnarp et al. |
| 2007/0012711 | A1 | 1/2007 | Kutsch et al. |
| 2007/0062549 | A1 | 3/2007 | Holton et al. |
| 2007/0130811 | A1 | 6/2007 | Shevelev et al. |
| 2007/0186941 | A1* | 8/2007 | Holton et al. ..... 131/352 |
| 2007/0261707 | A1 | 11/2007 | Winterson et al. |
| 2007/0262165 | A1 | 11/2007 | Landau |
| 2008/0029116 | A1 | 2/2008 | Robinson et al. |
| 2008/0290059 | A1 | 11/2008 | Benbassat |
| 2009/0014343 | A1 | 1/2009 | Clark et al. |
| 2009/0230003 | A1 | 9/2009 | Thiellier |

FOREIGN PATENT DOCUMENTS

| | | | |
|---|---|---|---|
| FR | 2361278 | A | 3/1978 |
| GB | 1004671 | A | 9/1965 |
| WO | WO 2007/034332 | A2 | 3/2007 |
| WO | WO 2008/148701 | A1 | 12/2008 |
| WO | WO 2009/092823 | A1 | 7/2009 |
| WO | 2009098590 | A1 | 8/2009 |
| WO | WO 2009/106493 | A1 | 9/2009 |
| WO | 2010080599 | A1 | 7/2010 |

OTHER PUBLICATIONS

International Search Report and Written Opinion mailed Jan. 7, 2009 for PCT/IB2008/001836.

International Search Report and Written Opinion mailed Mar. 18, 2011 for PCT/EP2010/006104.

International Preliminary Report on Patentability issued Apr. 19, 2012 for PCT/EP2010/006104.

Japanese Office Action dated Jan. 21, 2015 for corresponding Application No. 2012-532487.

* cited by examiner

FLAVORED PACKAGING INSERT FOR SMOKELESS TOBACCO

BACKGROUND

Conventional approaches to flavoring smokeless tobacco results short flavor shelf life, namely the loss of volatile flavor compounds and short flavor durations at the time of consumer use. Flavor loss over time is even more pronounced after the product is initially opened by the consumer.

SUMMARY

A package for smokeless tobacco comprises a pocket-sized package, smokeless tobacco inside the package, and at least one flavor patch inside the package, the flavor patch comprising a flavor.

In a further embodiment, a package for smokeless tobacco comprises a cylindrical can comprising a base, a cover, and an inner ring, wherein the inner ring provides a mechanical connection with the base and a friction fit with the cover such that the cover and base are supported only by the inner ring; and a flavor patch oriented circumferentially around an inside surface of the inner ring and comprising a flavor.

In another embodiment, a method of packaging smokeless tobacco comprises combining a package with a flavor patch disposed inside the package, the flavor patch comprising a flavor and an adsorbent, so that the flavor patch resides in an interior of the package; and adding smokeless tobacco to the package with the flavor patch.

BRIEF DESCRIPTION OF THE DRAWING FIGURES

DETAILED DESCRIPTION OF THE INVENTION

Figure 1:
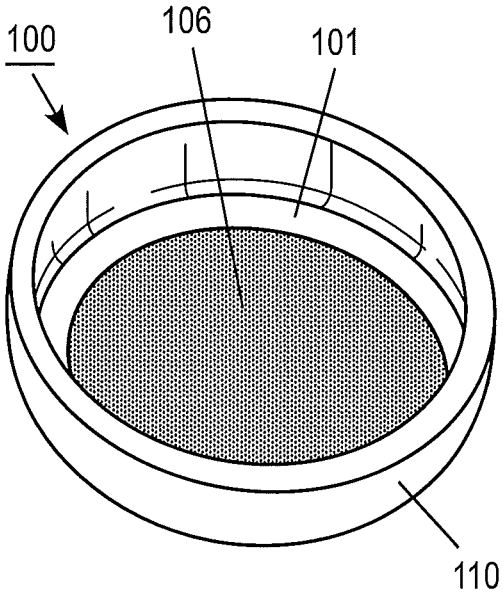
FIG. 1 illustrates an embodiment of a package containing a circular flavor patch.

As used herein, the term "orally enjoyable" denotes the ability of a material or product to be enjoyed and at least partially consumed via the mouth.

As used herein, the term "smokeless tobacco" denotes loose or wrapped tobacco orally enjoyable tobacco products, including snus and moist snuff tobacco ("MST") in portioned and non-portioned forms.

As used herein "packaged smokeless tobacco" denotes smokeless tobacco that is contained in a package as would be handled by a consumer.

As used herein, the term "volatile flavor" denotes a flavor sufficiently volatile such that, when it is applied in a conventional amount to packaged smokeless tobacco in a conventional, non-hermetically sealed package, the average consumer would notice a substantial decrease in the magnitude of the flavor within a period of about a month or less after the package is opened. Exemplary volatile flavors include wintergreen, mint, as well as "original" flavor as used in smokeless tobacco.

As used herein, the term "about" when used in conjunction with a stated numerical value or range has the meaning reasonably ascribed to it by a person skilled in the art, i.e. denoting somewhat more or somewhat less than the stated value or range, to within a range of ±10% of the stated value.

Smokeless tobacco such as smokeless tobacco may be flavored using liquid and/or dry flavors that are applied at a specific application ratio dependent upon tobacco weight. One process in which a liquid flavor is applied to the tobacco may be by pouring the flavor onto the tobacco or by spraying the flavor onto the tobacco using an atomization process.

Flavors applied to tobacco normally include one or more volatile flavor components, or may even by entirely or nearly entirely volatile flavors.

Flavor is lost during the atomization process and through the packaging, since the packaging is not hermetically sealed. As a result, the flavored product tends to continue to release and lose flavor via the venting or breathing inherent in the design of packaging for smokeless tobacco. Flavor loss can occur before and after newly-packaged smokeless tobacco reaches the consumer, and especially when the packaged smokeless tobacco is opened and closed by the consumer.

According to embodiments described herein, it is possible to provide for the continuous delivery of flavor to packaged smokeless tobacco. Thus, it may be possible to offset the loss of flavor of pre-flavored smokeless tobacco, or to add flavor to smokeless tobacco to which no volatile flavor has yet been added.

Smokeless Tobacco

Below are described preferred embodiments of smokeless tobacco (including MST and snus) used with a packaging insert as described herein.

The starting tobacco for preparing MST is preferably dark fire cured base tobacco as typically used for moist snuff in the United States, however other types of tobacco may be used. The tobacco is optionally subjected to one or more processing steps, and then subjected to a fermentation process. As examples of such pre-fermentation steps, a casing material may be applied to the tobacco, the tobacco may be aged, and one or more types of tobacco (e.g., different varieties, having different ages, from different fields, etc.) may be blended to ferment together, or a combination of such steps may be used. Such treatments may optionally be performed following fermentation.

After fermentation, the MST is preferably prepared into wrapped tobacco products, such as pouched smokeless tobacco. Other formats which may be combined with a flavor patch as described herein include loose cut tobacco, chewing tobacco, and pre-portioned tobacco.

The packaged MST product preferably has a moisture level of over 20% by weight, for example, 20 to 60%, e.g., 20, 25, 30, 35, 40, 45, 50, 55, or 60%, depending on the format.

Snus forms of smokeless tobacco generally do not begin with dark fire cured tobacco, but instead may use air-cured tobacco. Burley tobacco is preferably used to prepare snus. Snus is typically pasteurized.

Packaged snus tobacco typically has moisture content of equal to or less than 20%, for example 10 to 20%.

Packaging of Smokeless Tobacco

The smokeless tobacco is packaged in a pocket-sized package. Preferably, the package or container may be opened and closed by a consumer in order to access the smokeless tobacco. The package may take one of various forms, such as a cylindrical can, box, tube, or the like.

According to one embodiment, smokeless tobacco is packaged in a cylindrical can taking the form of a flat cylinder with a tight, friction-fitted lid. Preferably such a can is not hermetically sealed. Optionally, the lid may be screwed on with a threaded fitting. The flavor patch may be in the bottom inside of the can or the inside of the lid or both.

Another type of package used for smokeless tobacco is a pocket-sized hybrid container as disclosed in commonly-assigned U.S. Patent Application Publication No. 2009/0014343, the entirety of which is herein incorporated by reference. In an embodiment, such a package has the cover and outer base housing made of one material and the inner ring is of a second material. In a preferred embodiment, the cover and outer base housing are metal and the inner ring is plastic, the inner ring providing a mechanical connection with the base and a friction fit with the cover such that the cover and base are supported only by the inner ring. The hybrid container preferably contains consumer items within an interior volume defined by the space within the inner ring.

The package may be made of plastic, metal, paperboard, or a combination of materials. If plastic is used, a preferred plastic is high-density polyethylene.

The package is preferably slightly breathable (i.e., not hermetically sealed) rather than completely air-tight.

The Flavor Patch

The package containing the smokeless tobacco contains at least one flavor patch. Preferably the flavor patch is adhered to an interior surface of the package using a food-grade adhesive, however the flavor patch may be loose in the package. The package may be specially adapted to hold the flavor patch, for example with one or more protruding ridges or flanges, or in a compartment at least partially in communication with a compartment holding the smokeless tobacco. The flavor patch may optionally be an integral part of the package, for example formed into the package during the making of the package.

The flavor patch is preferably flat, with a thickness of from about 0.2 mm to about 2.8 mm. Exemplary thicknesses include 0.3 mm, 0.5 mm, 0.8 mm, 1.0 mm, 1.5 mm, 1.8 mm, and 2.0 mm.

The flavor patch preferably comprises an adsorbent made of a food-grade material able to hold the flavor and to slowly release it inside the package. Preferably, the flavor patch is comprised of highly adsorbent paper, however optionally it may be made of cotton, synthetic fibrous material, or a combination of materials. The patch may be a single layer in thickness, or comprise multiple layers which are preferably folded and/or laminated.

Flavor may be added to the flavor patch before or after it is combined with the package. Flavors that may be used as described herein include, but are not limited to, wintergreen, mint, menthol, and other flavors used with smokeless tobacco. The flavor is preferably applied to the flavor patch in the form of a liquid. Alternately, the flavor may be provided in the form of a film on the flavor patch, which preferably releases flavor when in a moist environment, such as a closed package of smokeless tobacco. The flavor patch preferably comprises one or more volatile flavors.

The flavor patch may have water added to it so that it serves to reduce drying of the smokeless tobacco during storage by providing a stable moisture environment.

The flavor patch optionally includes a film encapsulating the flavor and adapted to release the flavor in a moist environment. Exemplary films may comprise alginate, pectin, hydroxypropyl methylcellulose, and the like, and may optionally be cross-linked.

When the package is a cylindrical metal can, the flavor patch is preferably attached to an upper and/or lower section of the metal can, for example a lid and/or bottom of the can. A flavor patch in the lid of the can may desirably provide aroma to the consumer immediately upon the opening of the package, while an patch at the bottom of the package may provide constant flavor delivery to the smokeless tobacco. A flavor patch in the lid may provide a desirable visual indication to a consumer of the particular flavor it carries. The flavor patch may optionally be colored in order to indicate the particular flavor provided, with differently colored flavor patches corresponding to different flavors of smokeless tobacco.

FIG. 1 illustrates an embodiment of a cylindrical can-type package with a circular flavor patch 106. The bottom portion 100 of the package contains a flavor patch 106. The package has flat circular bottom 101, a curved side wall 110, and the flavor patch 106 is adhered to the bottom 101. The package, in its complete form is topped by a lid having a flat top (not shown), which in turn may have an optional flavor patch. The flavor patch is preferably adhered to a flat surface with food-grade adhesive. In another embodiment, the flavor patch can be a strip extending circumferentially around an interior of the can. Preferably, the flavor patch covers a majority of the surface to which it is adhered.

Figure 2:
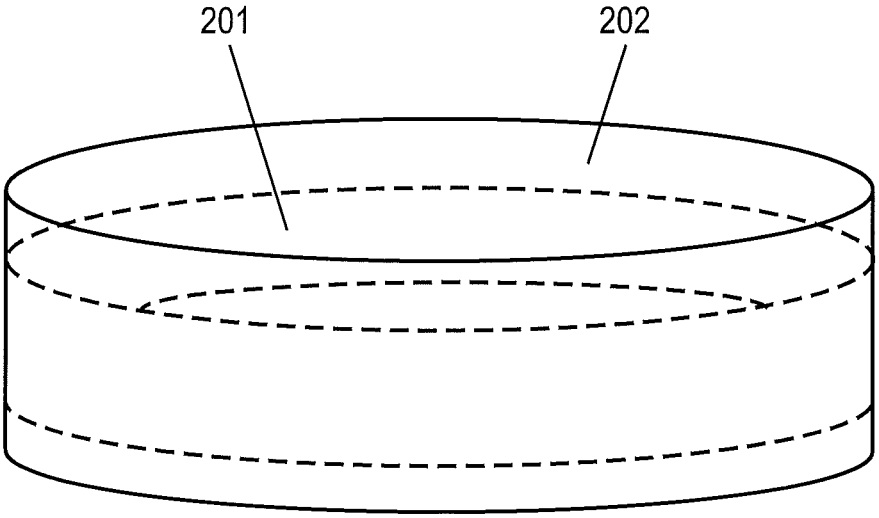
FIG. 2 illustrates an embodiment of a flavor patch in the form of a strip around the interior of an inner ring insert of a cylindrical can package.

FIG. 2 illustrates an embodiment of a different form of cylindrical can package, wherein the flavor patch 201 takes the form of a strip around the interior of an inner ring insert of the package 202. The inner ring insert 202 is oriented vertically between the top (not shown) and bottom (not shown) of the cylindrical can. A package for smokeless tobacco comprising such an inner ring insert is described in commonly-assigned U.S. Patent Application Publication No. 2009/0014343, incorporated herein by reference. The flavor patch preferably extends along the entire inner circumference of the can, or nearly so.

Figure 3A:
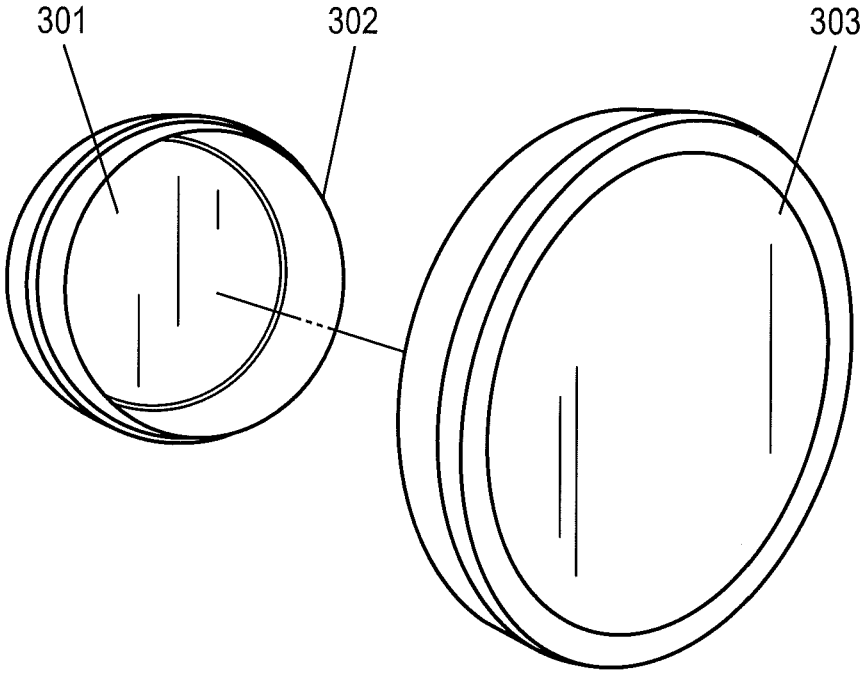
FIG. 3A is a partially exploded view.
Figure 3B:
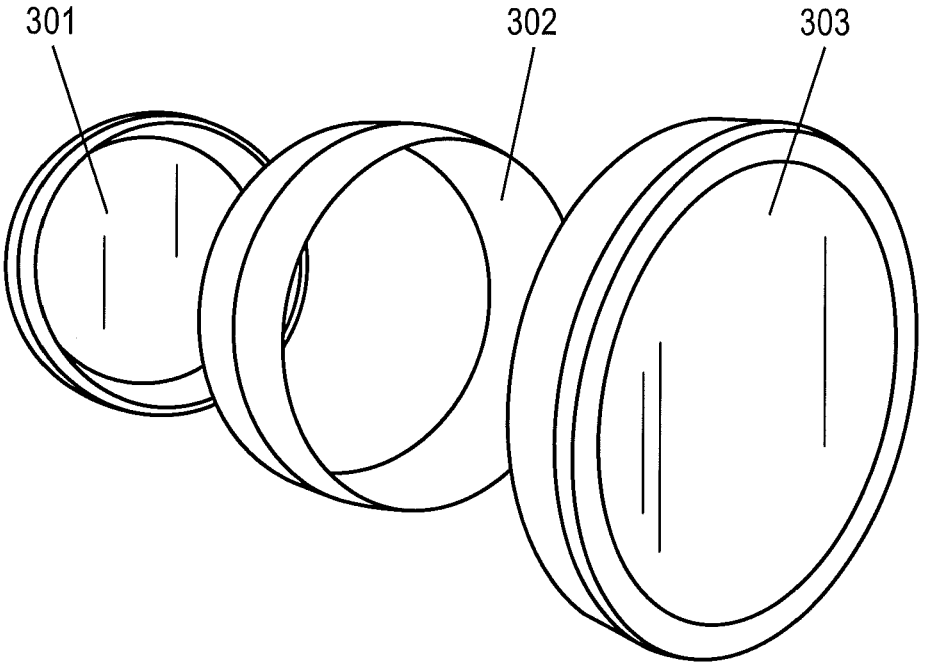
FIG. 3B is a fully exploded view of an embodiment of a cylindrical can with an inner ring insert for a strip-shaped flavor patch.

FIG. 3A is a partially exploded view and FIG. 3B is a fully exploded view of an embodiment of a cylindrical can with an inner ring insert. Inner ring insert 302 is seated in bottom portion 301 and a top lid 303 is friction fitted as a cover. A flavor patch, not shown, is inside the inner circumference of the inner ring insert 302.

Packaged smokeless tobacco may contain a combination of flavor patch configurations described herein. For example, a cylindrical can of smokeless tobacco may contain a flavor patch on an inside surface of the lid as well as a flavor patch extending circumferentially along an inside vertical wall, such as that of an inner ring insert, with or without a third patch on an inside surface of the bottom of the can.

A flavor delivery system as described herein can continue to enhance and stabilize the flavor contained in packaged smokeless tobacco after it is opened by the consumer. In particular, it can result in increased flavor intensity, duration, and flavor shelf life as compared to packaged smokeless tobacco without a flavor patch.

EXAMPLE

Cylindrical cans for smokeless tobacco were prepared by adhering a thin circular cotton patch to the lid of the can. Flavor patches were flavored by application of a quantity of liquid flavor using an amount of flavor based on the weight of tobacco to be added to the can. Three different flavor systems were used: wintergreen, original (also called regular), and mint. Unflavored smokeless tobacco (that is, smokeless tobacco to which no volatile flavor was applied) was placed inside the container with the flavor patch and allowed to homogenize for 24 hours.

After 24 hours, each container was opened and inspected. The flavor patch delivery system was found to be very effective in providing flavor to the unflavored smokeless tobacco for each of the flavors used. The cans with flavor patches persisted in providing flavor to the smokeless tobacco for a period of two to three months.

All of the above-mentioned references are herein incorporated by reference in their entirety to the same extent as if each individual reference was specifically and individually indicated to be incorporated herein by reference in its entirety.

Although the invention has been described with reference to particular embodiments and examples, it should be understood that various modifications can be made without departing from the spirit of the invention. The various parts of the disclosure including the abstract, summary, and the title are not to be construed as limiting the scope of the present invention, as their purpose is to enable the appropriate authorities, as well as the general public, to quickly determine the general nature of the invention. Unless the term "means" is expressly used, none of the features or elements recited herein should be construed as means-plus-function limitations pursuant to 35 U.S.C. §112, ¶6. Accordingly, the invention is limited only by the claims.

What is claimed is:

1. A method of packaging smokeless tobacco, comprising the steps of:

(a) combining a pocket-size package with at least one flavor patch disposed inside the package, the at least one flavor patch comprising an adsorbent material and a flavor releasably adsorbed in the adsorbent material, wherein the at least one flavor patch resides in an interior of the package; wherein the package comprising a can having a base and a cover; wherein the adsorbent material is selected from the group consisting of paper, cotton, synthetic fibrous material or combination thereof;

(b) adding smokeless tobacco to the package with the at least one flavor patch; then (c) closing the can with the cover such that the can is not hermetically sealed.

2. The method of claim 1, wherein, before said adding, the smokeless tobacco is devoid of added volatile flavors.

3. The method of claim 1, wherein the flavor is selected from the group consisting of wintergreen flavor and mint flavor.

4. The method of claim 1, wherein the package comprises a cylindrical can.

5. The method of claim 4, wherein the least one flavor patch extends circumferentially along the interior of the cylindrical can.

6. The method of claim 4, wherein the cylindrical can comprises an inner ring provides a mechanical connection with the base and a friction fit with the cover such that the cover and base are supported only by the inner ring; and wherein the flavor patch extends circumferentially along an inside surface of the inner ring.

7. The method of claim 1, wherein the flavor patch has a color corresponding to the flavor.

8. The method of claim 1, wherein the flavor patch further comprises a film encapsulating the flavor with the adsorbent, and adapted to release the flavor in a moist environment.

9. The method of claim 1, wherein the smokeless tobacco inside the package comprises a form selected from the group consisting of loose smokeless tobacco; snus; pre-portioned tobacco; and one or more pouches, each of which comprises tobacco.

10. The method of claim 1, wherein the at least one flavor patch comprises a first flavor patch disposed on the cover of the can and a second flavor patch disposed in the base of the can.

11. The method of claim 1, wherein the at least one flavor patch comprises food-grade paper and has a thickness of from about 0.2 mm to about 2.8 mm.

12. The method of claim 1, wherein the at least one flavor patch further comprises an amount of water sufficient to reduce drying of the smokeless tobacco during storage.

13. The method of claim 1, wherein the at least one flavor patch is adhered to the package with a food-grade adhesive.

14. The method of claim 1, wherein the package is a pocket-sized package in the shape of a cylindrical can and the at least one flavor patch comprises food-grade paper and has a thickness of from about 0.2 mm to about 2.8 mm.

* * * * *